US005409177A

United States Patent [19]

Parry et al.

[11] Patent Number: 5,409,177

[45] Date of Patent: Apr. 25, 1995

[54] PIGGYBACK WRAPPER

[75] Inventors: John C. Parry; David J. Parry; Daniel J. Parry, all of Severna Park, Md.

[73] Assignee: J. C. Parry & Sons Co., Inc., Baltimore, Md.

[21] Appl. No.: 98,002

[22] Filed: Jul. 29, 1993

[51] Int. Cl.[6] ..... B65H 75/40

[52] U.S. Cl. ..... 242/421; 242/422; 242/588; 242/588.2

[58] Field of Search ..... 242/96, 99, 75.4, 68, 242/594, 594.2, 594.4, 588.2, 422.4, 588, 421, 422; 53/135.3, 173.2, 176, 587; 156/577, 579

[56] References Cited

U.S. PATENT DOCUMENTS

| | | | |
|---|---|---|---|
| 3,367,589 | 2/1968 | Chant, Jr. et al. | 242/55.3 |
| 3,442,064 | 5/1969 | Conti | 53/390 |
| 3,483,060 | 12/1969 | Yow-Jiun-Hu . | |
| 3,496,700 | 2/1970 | McCabe et al. | 53/167 |
| 3,508,692 | 4/1970 | Holtan . | |
| 3,557,516 | 1/1971 | Brandt | 53/137.2 X |
| 3,601,327 | 8/1971 | Baumann . | |
| 4,102,513 | 7/1978 | Guard | 242/75.4 |
| 4,191,342 | 3/1980 | Reinhold | 242/68.5 X |
| 4,339,022 | 7/1982 | Hoover | 192/14 |
| 4,402,784 | 9/1983 | Romero-Medrano . | |
| 4,417,701 | 11/1983 | Moritz . | |
| 4,530,473 | 7/1985 | Parry | 242/55.3 |
| 4,535,951 | 8/1985 | Riemenschneider, III | 242/99 X |
| 4,610,407 | 9/1986 | Stubbmann | 242/55.2 |
| 4,612,076 | 9/1986 | Moss . | |
| 4,630,786 | 12/1986 | Lambert et al. | 242/96 |
| 4,651,499 | 3/1987 | Krichiver | 53/176 X |
| 4,714,211 | 12/1987 | Hwang | 242/96 |
| 4,872,623 | 10/1989 | Parry et al. | 242/96 |
| 4,915,768 | 4/1990 | Söderberg | 156/579 X |
| 5,013,595 | 5/1991 | Parry | 428/77 |
| 5,046,298 | 9/1991 | Norkoski et al. | 53/587 X |
| 5,203,517 | 4/1993 | Parry et al. | 242/96 |

FOREIGN PATENT DOCUMENTS

| | | | |
|---|---|---|---|
| WO90/12737 | 11/1990 | WIPO | 53/587 |

*Primary Examiner*—Daniel P. Stodola
*Assistant Examiner*—John P. Darling
*Attorney, Agent, or Firm*—Shoemaker and Mattare, Ltd.

[57] ABSTRACT

A stretch film wrapping device includes a frame supporting at least one flexible hollow handgrip. An end of a core of a roll of stretch film is inserted into the hand grip, so that braking force on the film may be regulated by squeezing the hand grip as film is applied to an array of articles. The device also supports at least one reel of auxiliary narrow band material on an axis different from that of the stretch film roll, so that the band material and the stretch film may be simultaneously applied.

9 Claims, 4 Drawing Sheets

FIG. 2
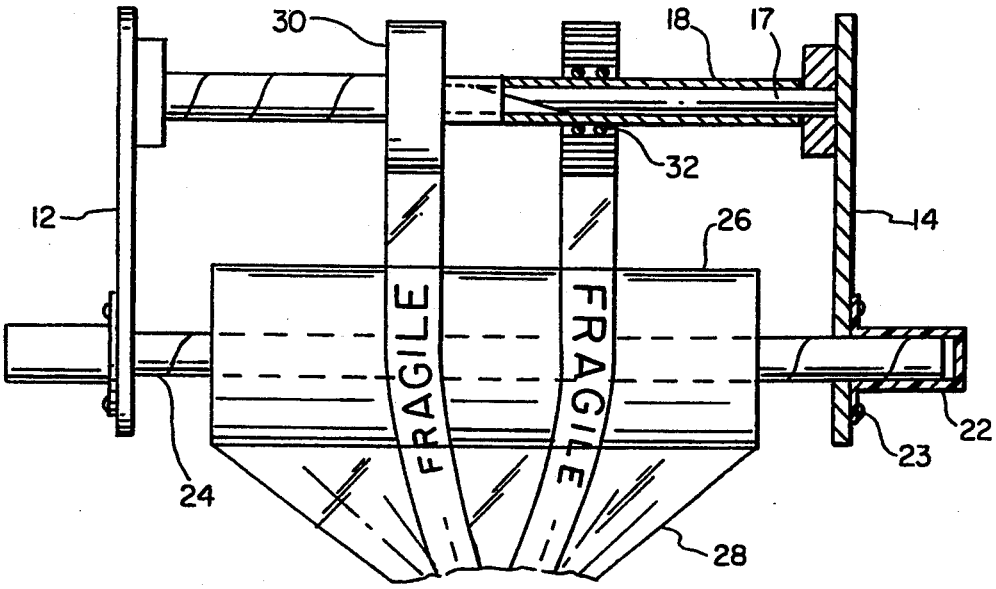
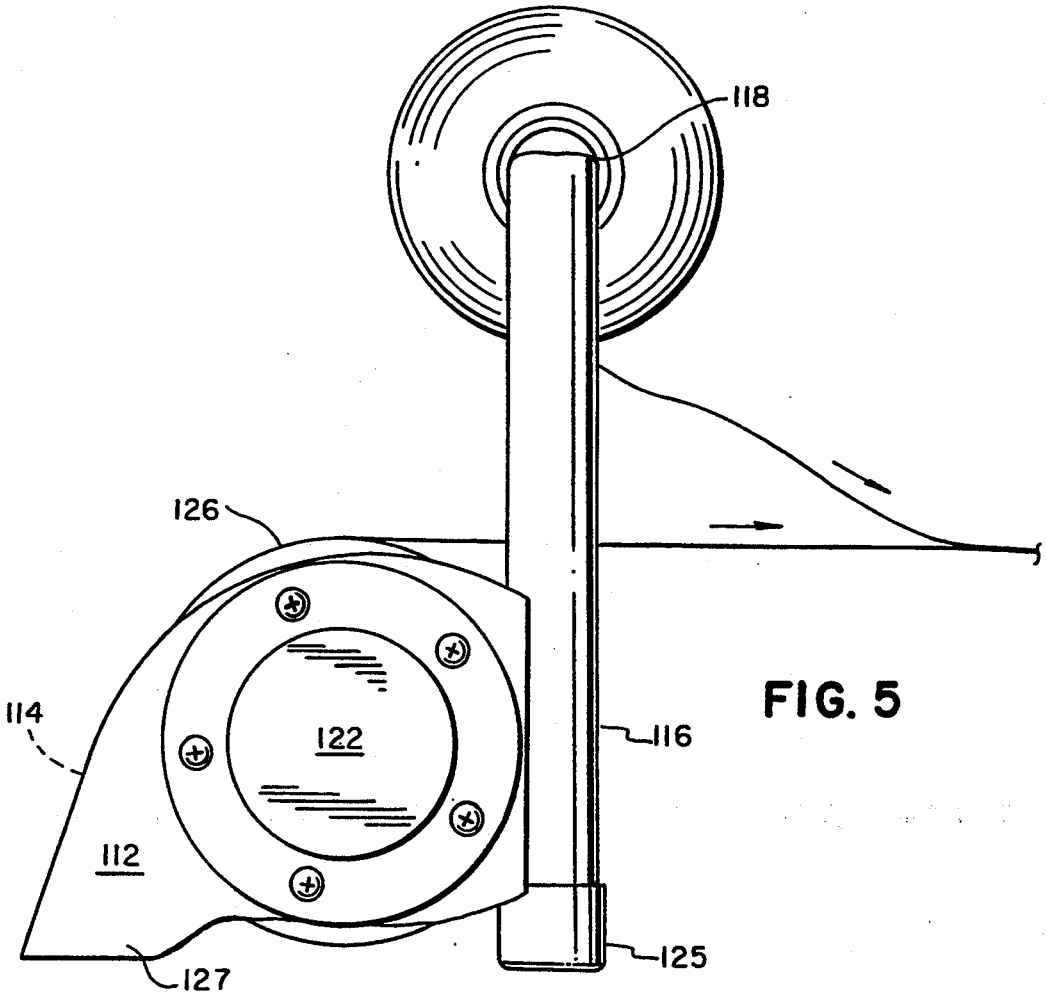
FIG. 5

FIG. 4
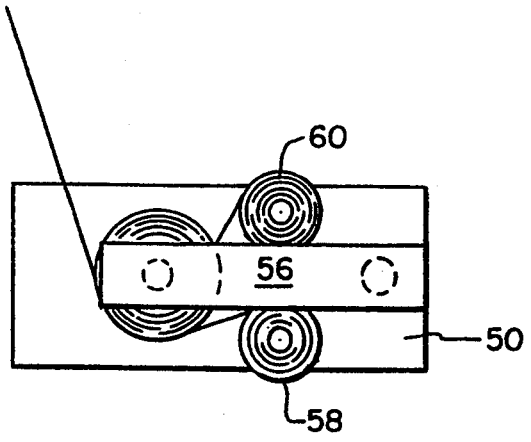
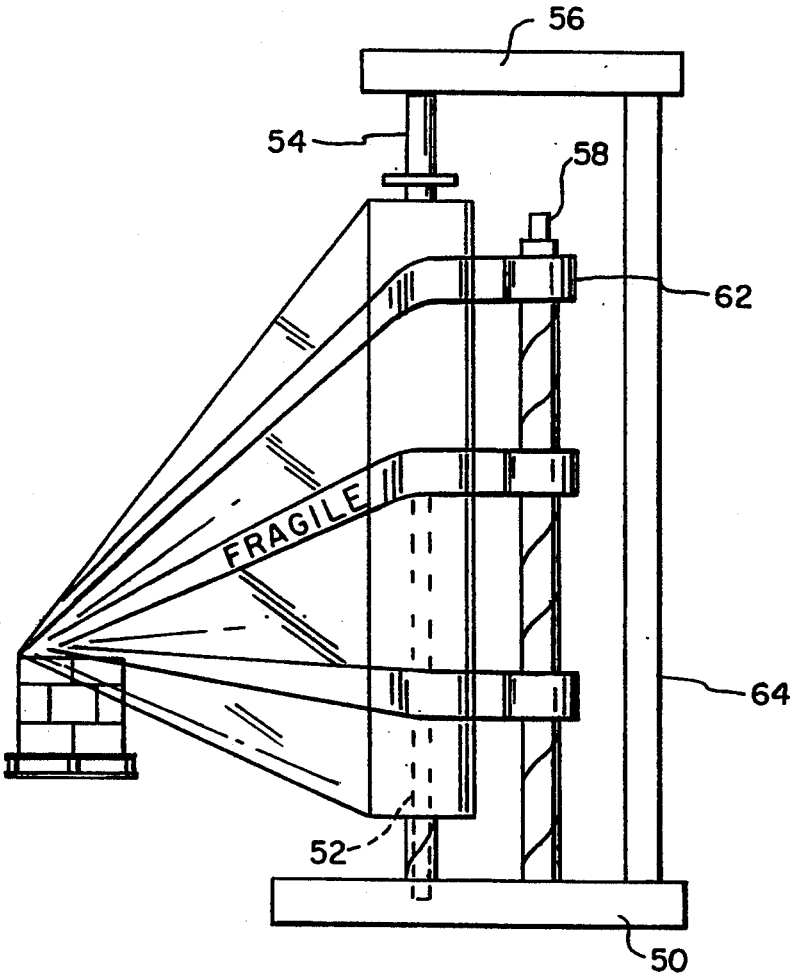
FIG. 3

PIGGYBACK WRAPPER

BACKGROUND OF THE INVENTION

This invention relates generally to packaging, and more particularly to a hand-held stretch film wrapper for wrapping a stack of articles on a pallet.

A number of prior inventors, including the present inventors, have developed hand-held devices with which one can conveniently roll off stretch film as he wraps a pallet loaded with cartons or other products. The present inventors have a number of patents on such devices, typified by a flexible hand grip which can be squeezed to regulate the braking force on the roll. See, e.g., U.S. Pat. Nos. 5,203,517; 4,872,623; 4,179,081 and 4,530,473. Using such devices, a person can control the amount of stretch developed in the film as it is applied.

The present inventors also invented a wrapping laminate including a stretch film and a narrow auxiliary band of polymeric material. See U.S. Pat. No. 5,013,595. This combination has proved commercially successful when the polymeric band is imprinted, for example with a warning message, a logo identifying the shipper, or ornamentation such as "Happy Mothers' Day". A narrow band is easier to print on than a wide one, and the material of the narrow band can be chosen primarily for its print-receiving qualities, while the underlying stretch film is chosen for its mechanical characteristics.

Until now, it has been customary to rewind stretch film in a factory, while simultaneously feeding the auxiliary band of material into the film, to provide the end user with a pre-laminated product. It would give the user more flexibility, however, to provide him with a simple device with which he could custom-wrap pallets with various auxiliary bands while applying stretch film.

SUMMARY OF THE INVENTION

An object of the invention is to provide a hand-held device with which one can apply stretch film to an array of articles, such as boxes stacked on a pallet, to unify and protect the articles, while allowing for regulation of the braking force applied to the film.

Another object of the invention is to enable one to apply, simultaneously, a narrow auxiliary band of material, such as printed material, to the pallet as it is wrapped with stretch film.

A further object of the invention is to enable a person to apply a substantial number of auxiliary bands simultaneously, during stretch film wrapping.

These and other objects are attained by a stretch film wrapping device having a pair of interconnected side plates, each with a hole therethrough and a flexible hollow handgrip permanently affixed to the side plate over the hole. The ends of a core of a roll of stretch film are inserted into the handgrips, whereby braking force on the film may be regulated by squeezing the handgrips as film is applied to an array of articles. The device also supports at least one reel of auxiliary narrow band material on an axis different from that of the stretch film roll, so that the band material and the stretch film may be simultaneously applied.

BRIEF DESCRIPTION OF THE DRAWINGS

In the accompanying drawings,

FIG. 2 is a top plan view thereof, half in section FIG. 3 is a front elevation of a second embodiment of the invention;

FIG. 4 is a top plan view thereof;

FIG. 5 is a view of third embodiment of the invention; and

DESCRIPTION OF THE PREFERRED EMBODIMENT

Figure 1:
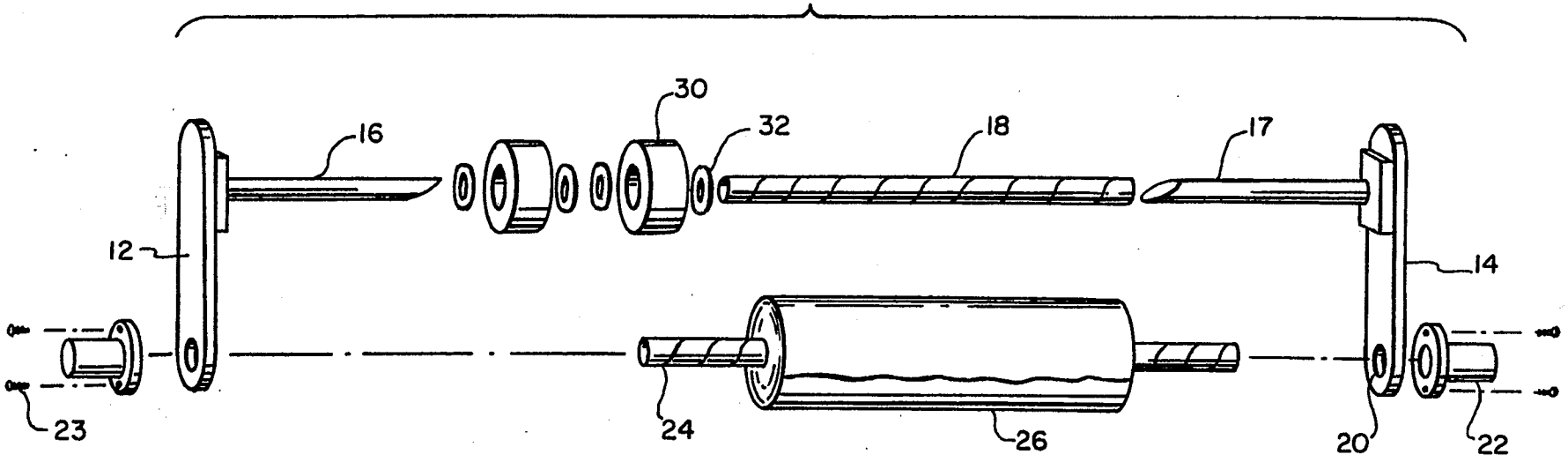
FIG. 1 is an exploded perspective view of a stretch film wrapper embodying the invention.

A stretch film wrapper embodying the invention, illustrated in FIGS. 1–2, includes a frame comprising a first side plate 12, a second side plate 14, and a rod interconnecting the side plates at one end. The rod is split at the middle into two stubs 16,17, one of which is permanently affixed to each of the side plates. When the device is assembled (FIG. 2), the stubs are surrounded by a closely fitting sleeve 18, which may be a cardboard tube, which provides bending resistance and unifies the halves of the rod. The rod studs 16 and 17 and sleeve 18 have a slight interference fit sufficient to hold the device together. Each of the side plates has a hole 20 at its forward end, and a hand grip 22 is permanently affixed over the hole, that is, coaxial with it, at the outboard side of the plate. The hand grip is described in detail in U.S. Pat. No. 5,203,517, whose disclosure is incorporated herein by reference. The hand grip's flange may be affixed by discrete fasteners such as screws 23, or by an adhesive, in a way so that it cannot rotate with respect to its side plate. The side plates, with hand grips attached, are assembled over opposite ends of a the cardboard core 24 of a roll 26 of stretch film 28 so that the core substantially fills the interior of each grip, and can be braked thereby when the grips are squeezed so as to drive the ribbed interior surfaces of the grips against the surface of the core.

Prior to assembly of the device, one or more reels 30 of pre-printed or colored auxiliary band material are installed on the sleeve 18. Means such as O-rings 32 may be positioned in the space between the interior of the each reel 30 and the outer surface of the sleeve 18, to provide some resistance to turning, so that the band is maintained taut during wrapping.

In use, a leading edge of material is drawn from both the stretch film roll and the reel(s) of auxiliary band material, and affixed to an array of articles (not shown) on a support such as a pallet. Care is taken to get the printing, if any, oriented properly, and to position the layers, if possible, so that the printed band is eventually covered by stretch film. This protects the printing ink from damage. Now, as he walks around the pallet (or the pallet is rotated on a turntable), the operator squeezes the hand grips sufficiently to get the desired degree of stretch as the film is payed out. It is not important to control the tension of the auxiliary bands, since their purpose is to convey information. It is necessary only to prevent the bands from becoming slack, and the O-rings perform this retardation function without requiring attention.

When the supply of either stretch film or auxiliary band is exhausted, the two side plates are pulled apart, freeing the core of the stretch film roll, and the sleeve upon which the auxiliary band reels were positioned. Fresh reels are installed, and the device reassembled by pushing the halves of the device back together.

A modified form of the invention is shown in FIGS. 3–4. This device has only one hand grip, the lower grip having been replaced by a sole plate 50, so that the device can be stood on the floor with the hand grip uppermost. A rod 52 permanently affixed to the sole plate, supports the core of a stretch film roll, whose upper end extends into a hand grip 54 attached to the upper plate 56. Again, the flange of the hand grip is fastened permanently to the upper plate.

The sole plate and the upper plate 56 are interconnected by a bar 64.

A pair of shafts 58, 60 also extend upward from the sole plate, both parallel to, and on either side of, the rod 52. One or more reels 62 of auxiliary band material can be dropped over either shaft, each preferably with means (not shown) for braking the reel to maintain tension.

Use of the modified form of the invention is like that of the form shown in FIGS. 1–2, except that braking is done only with the upper hand grip. The other hand may grasp the bar 64 near the bottom, for example one of the shafts.

The third embodiment of the invention, shown in FIG. 5, is functionally similar to that of FIG. 1, in that it has a pair of handgrips 122, each mounted on a respective side plate 112,114 at either end of the stretch film roll 126. In this embodiment, each side plate has one edge along which one leg of a U-shaped metal tubular support 116 is attached, as by screws. Plastic caps 125 over the ends of the tubing provide two feet on which the device can rest on a floor. Protuberances 127 formed on the side plates provide another two feet. Item 118 is a stationary paperboard core, clamped to the tubing, upon which auxiliary band reels are mounted. Operation of the device is substantially as described above for the first embodiment.

Figure 6:
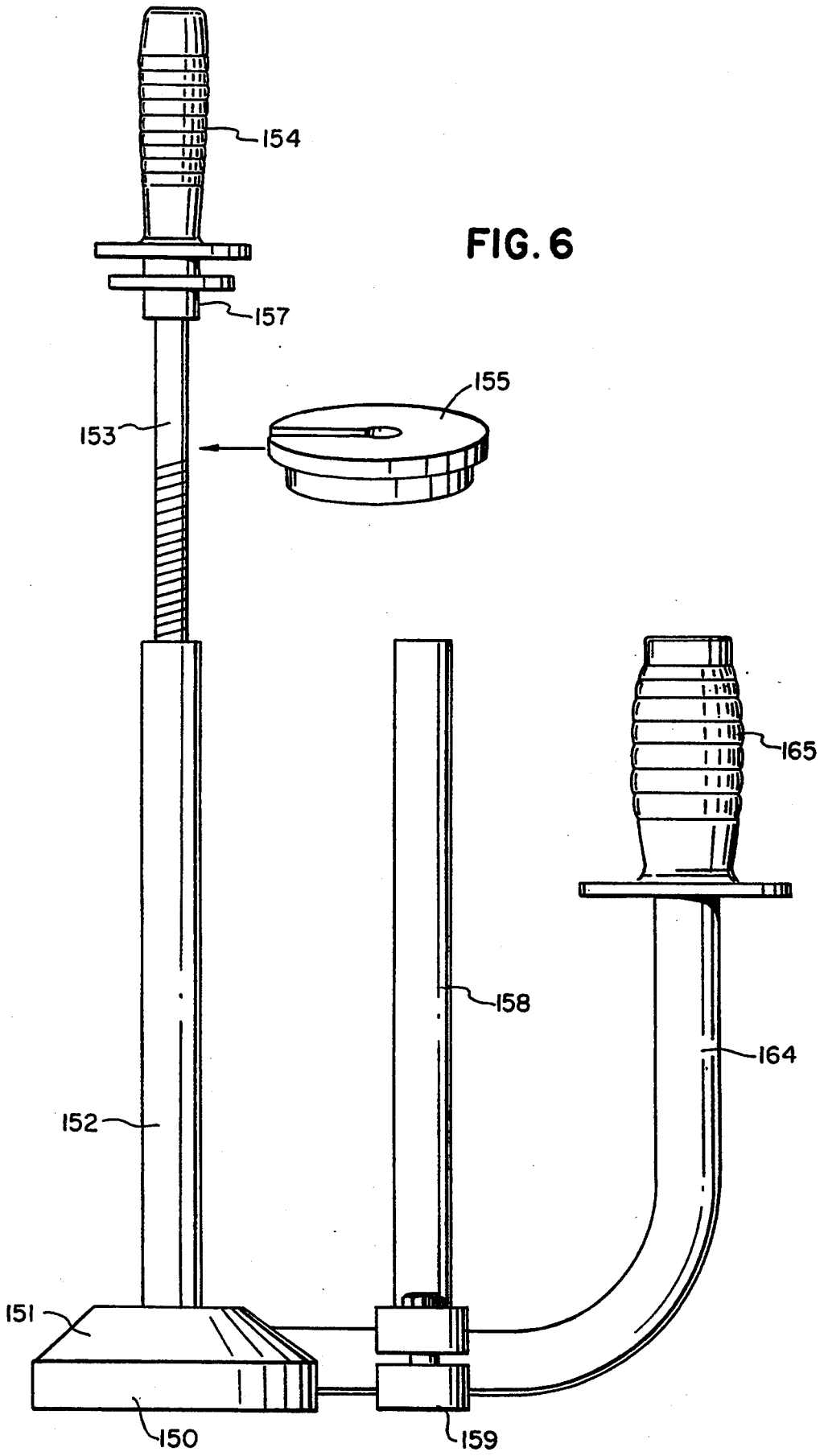
FIG. 6 depicts a fourth embodiment of the invention.

The fourth embodiment of the invention, FIG. 6, is functionally more like that of FIGS. 3–4, since it has a single base plate 150 and can stand upright on the floor. The base has a frustoconical upper surface 151 designed to support a stretch film roll (not shown) having a three-inch diameter core, which tends to bé centered on the frustoconical surface. An upright 152 extends vertically from the center of the base plate. The upper end of the upright is internally threaded, and receives a threaded rod 153 having a handgrip 154 at its upper end. This grip, unlike those described above, does not apply braking force to the roll. It is mounted on the upper end of the rod tightly, so that it can turn the rod to increase axial loading of the film roll core. The slotted insert 155 depicted keeps the core centered around the rod, and transmits the preload from the bushing 157 to the core.

A curved "J"-shaped handle 164 extends away from the base plate. A second handgrip 165 is pushed onto the upper end of the handle. A second upright 158, parallel to the first, is attached to a horizontal portion of the handle, for example by the tubing clamp 159 illustrated. In use, one places one or more reels of auxiliary band material on the second upright, and, supporting the device by its two handgrips, applies film and band material simultaneously to an array of articles. The degree of stretch can be regulated by turning the upper grip.

It should be understood that the invention is subject to many changes and improvements. For example, the side plates and base plates described above can be made of any suitably rigid material, such as wood or plastic; the proportions of the device may be altered; and the way in which the parts are interconnected may vary.

Also, while the elements described above are presently preferred not all are essential to the invention in its broadest sense. For example, one could eliminate the handgrips, and apply a braking force directly to the roll core with bare or gloved hands.

Since the invention is subject to modifications and variations, it is intended that the foregoing description and the accompanying drawings shall be interpreted as illustrative of only one form of the invention, whose scope is to be measured by the following claims.

We claim:

1. A stretch film wrapping device comprising
a rigid frame, comprising a pair of side plates,
means on the frame for supporting a roll of stretch film having a first width, for rotation on a first axis,
means for applying a braking force to said roll as film is payed out from it, and
means for supporting at least one reel of auxiliary band material, having a second width substantially less than said first width, on a second axis different from that of the stretch film roll, whereby one can simultaneously apply said stretch film and said auxiliary band material to an array of items
wherein the braking means comprises a flexible handgrip, affixed to one of the side plates, for receiving the end of a core extending from said stretch film roll, whereby one can regulate the braking force on the film during film application by squeezing the handgrip.

2. The invention of claim 1, wherein the rigid frame comprises a pair of side plates, each having a hole through which an end of a core extending from the film roll can extend, and means for interconnecting the side plates, and
the braking means comprises a pair of handgrips, one affixed to each of said side plates, into which a respective end of the core is inserted, whereby one can regulates the braking force on the film during film application by squeezing the handgrips.

3. The invention of claim 1, wherein said interconnecting means comprises a pair of stub rods, one affixed to each of said side plates, and a sleeve having an interference fit with said stub rods, whereby the stub rods may be pushed into the sleeve to assemble the wrapping device.

4. The invention of claim 3, wherein the sleeve also is the means for supporting the auxiliary band reel.

5. A stretch film wrapping device comprising
a pair of side plates,
each of said side plates having a hole therethrough with a flexible hollow handgrip permanently affixed to the side plate over the hole,
means for interconnecting the side plates,
means for supporting a roll of stretch film wound on a core between the side plates, so that the core of the roll extends into both handgrips whereby braking force on the film may be regulated by squeezing the handgrips as film is applied to an array of articles, and
means for supporting at least one reel of auxiliary band material on an axis different from that of the stretch film roll.

6. The invention of claim 5, further comprising means for braking the auxiliary band material reel so as to maintain tension in the band material as stretch film is applied.

7. The invention of claim 5, wherein said interconnecting means comprises a pair of stub rods, one affixed to each of said side plates, and a sleeve having an interference fit with said rods, whereby the rods may be pushed into the sleeve to assemble the wrapping device.

8. The invention of claim 7, wherein the sleeve also is the means for supporting the auxiliary band reel.

9. The invention of claim 5, wherein the means for supporting the stretch film roll is the core upon which the stretch film is wound.

* * * * *